US010655317B2

(12) United States Patent
Lappalainen et al.

(10) Patent No.: US 10,655,317 B2
(45) Date of Patent: May 19, 2020

(54) METHOD FOR CONTROLLING A VACUUM SEWAGE SYSTEM FOR A BUILDING OR FOR A MARINE VESSEL

(71) Applicant: EVAC OY, Espoo (FI)

(72) Inventors: Vesa Lappalainen, Vantaa (FI); Mika Karjalainen, Klaukkala (FI)

(73) Assignee: EVAC OY, Espoo (FI)

( * ) Notice: Subject to any disclaimer, the term of this patent is extended or adjusted under 35 U.S.C. 154(b) by 0 days.

(21) Appl. No.: 16/073,250

(22) PCT Filed: Jan. 25, 2017

(86) PCT No.: PCT/FI2017/050040
§ 371 (c)(1),
(2) Date: Jul. 26, 2018

(87) PCT Pub. No.: WO2017/129862
PCT Pub. Date: Aug. 3, 2017

(65) Prior Publication Data

US 2019/0003171 A1 Jan. 3, 2019

(30) Foreign Application Priority Data

Jan. 26, 2016 (FI) ..... 20165048

(51) Int. Cl.
*E03F 1/00* (2006.01)
*B63J 4/00* (2006.01)

(52) U.S. Cl.
CPC ..... *E03F 1/007* (2013.01); *B63J 4/006* (2013.01); *E03F 1/006* (2013.01)

(58) Field of Classification Search
CPC ..... E03F 1/006; E03F 1/007
See application file for complete search history.

(56) References Cited

U.S. PATENT DOCUMENTS 5,117,677 A 6/1992 Hendershot et al.
6,131,596 A * 10/2000 Monson ..... E03F 1/007 137/14

(Continued)

FOREIGN PATENT DOCUMENTS

CN 101611201 A 12/2009
CN 101889146 A 11/2010

(Continued)

OTHER PUBLICATIONS

Search Report for related Finland Application No. 20165048; report dated Aug. 25, 2016.

(Continued)

*Primary Examiner* — Kevin F Murphy
(74) *Attorney, Agent, or Firm* — Miller, Matthias & Hull LLP

(57) ABSTRACT

Method for controlling a vacuum sewage system for a building or for a marine vessel, which includes a vacuum unit (11), vacuum piping (7), a source of sewage (91, 92, 93, 94), and a discharge valve (8) between each source of sewage and the vacuum piping, wherein the vacuum unit generates a predetermined vacuum level in the vacuum piping, in which method the operation of the vacuum sewage system is monitored. In order to ensure an efficiently operating vacuum sewage system, the running time of the vacuum unit is monitored and the vacuum level of the vacuum piping is monitored.

13 Claims, 4 Drawing Sheets

(56) References Cited

U.S. PATENT DOCUMENTS

| | | | | |
|---|---|---|---|---|
| 8,028,715 | B2 * | 10/2011 | Shimizu | E03F 1/006 137/465 |
| 8,381,324 | B2 * | 2/2013 | Lappalainen | B60R 15/00 4/431 |
| 2003/0010092 | A1 | 1/2003 | Lu et al. | |
| 2011/0192465 | A1 * | 8/2011 | Collings, III | E03F 1/006 137/1 |

FOREIGN PATENT DOCUMENTS

| | | | |
|---|---|---|---|
| CN | 102135234 | A | 7/2011 |
| CN | 102235575 | A | 11/2011 |
| CN | 106092463 | A | 11/2016 |
| DE | 102010016524 | A1 | 10/2011 |
| EP | 1172492 | A2 | 1/2002 |
| JP | 3164750 | B2 | 5/2001 |
| JP | 4864513 | B2 | 2/2012 |
| WO | 0250381 | A1 | 6/2002 |

OTHER PUBLICATIONS

International Search Report and written opinion for related Finland Application No. PCT/FI2017/050040; report dated Apr. 21, 2017.

* cited by examiner

METHOD FOR CONTROLLING A VACUUM SEWAGE SYSTEM FOR A BUILDING OR FOR A MARINE VESSEL

TECHNICAL FIELD

The present invention relates to a method for controlling a vacuum sewage system for a building or for a marine vessel, which vacuum sewage system includes a vacuum unit, vacuum piping with at least a main pipe line and at least a branch pipe, a source of sewage, and a discharge valve between each source of sewage and the vacuum piping, wherein the vacuum unit generates a predetermined vacuum level in the vacuum piping, in which method a running time of the vacuum unit is monitored, and in which method a vacuum level in the vacuum piping is monitored, according to the pre-characterizing portion of claim 1.

BACKGROUND ART

The vacuum piping in a vacuum sewage system for a building or for a marine vessel can include quite a large piping network, which e.g. at connections, branches, traps and drains is subject to leakage, particularly during extended use. Furthermore, the sewage transported in the vacuum sewage system tends to form deposits and layers in the vacuum piping particularly due to the small diameter of the vacuum piping. The diameter of such vacuum piping in a vacuum sewage system is generally between 40 mm to 60 mm. Blockage or partial blockage may also occur due to various reasons, e.g. accumulated deposits or layers, or undesired material that has been discharged into the vacuum piping. Such blockages or partial blockages are detrimental, taking into account said small diameter of the vacuum sewage piping. In large piping networks the detection and localization of such problematic occurrences is difficult.

Various arrangements for monitoring leakage of vacuum sewage system are known. WO 02/50381 A1 discloses a system in which sewage is discharged by gravity from a building into an external collection tank from which sewage is separately and subsequently further transported by vacuum. The known system includes a control system for monitoring the failure of a vacuum valve through which sewage is discharged from the external collection tank into a vacuum piping based on monitoring excess running time of a vacuum pump. JP 3164750 B2 discloses a corresponding system where leakage of air into a vacuum system is detected by monitoring the flow-through and the running time of a vacuum pump. JP 4864513 B2 also discloses a corresponding system, in which leakage of the vacuum piping is monitored by several vacuum sensors. The known systems are limited only to leakage control.

SUMMARY OF THE INVENTION

An object of the present invention is to detect blockage or formation of deposits or layers in the vacuum piping. Another object of the present invention is to localize the blockage or partial blockage, deposits or layers in the vacuum piping. These objects are attained by means of a method according to claim 1.

Additional objects of the present invention are to detect leakage in the vacuum piping as well as to localize the leakage in the vacuum piping.

The basic idea of the present invention is to monitor the operation of the vacuum unit in order to detect deviations to normal designed running times and vacuum levels.

For detecting a deviation to a normal designed running time of the vacuum unit, a first given reference value for a running time during a predetermined time period is determined. When the running time of the vacuum unit is short in comparison to the first given reference value, there is an indication that a deposit or layer has formed in the vacuum piping causing a blockage or partial blockage.

In order to localize the place of a problematic occurrence, such as a deposit, layer, partial blockage or blockage in the vacuum piping, based on monitoring the running time of the vacuum unit, the vacuum level in the vacuum piping is monitored at least at two separate predetermined positions of the vacuum piping.

The vacuum levels monitored at the at least two separate predetermined positions are compared in connection with a discharge or flushing sequence of the source of sewage.

The running time is advantageously monitored by a running time meter unit, which registers the running time of the vacuum unit. The running time meter unit can be included in the control panel of the vacuum unit.

A total registered running time within a predetermined time period is measured. This total running time can then be compared to the first given reference value for the total running time that can be acquired by carrying out the monitoring within a predetermined time period during e.g. a one month's time when the vacuum sewage system is taken into use and still intact and when the vacuum piping is still clean and un-contaminated, i.e. without blockage, partial blockage, deposits or layers formed in the vacuum piping.

Advantageously, the vacuum level is monitored by at least two vacuum sensors placed in each branch pipe of the vacuum piping. The vacuum levels indicated by a set of two adjacent vacuum sensors placed in a branch pipe are compared in connection with a discharge or flushing sequence of the source of sewage. In this manner, a more precise location of the problematic occurrence can be determined.

In normal operation the vacuum level in the branch pipe should clearly decrease in connection with a discharge or flushing sequence. However, if the decrease is yet more radical, there is a clear indication that a blockage, partial blockage, deposit or layer has formed in the branch pipe, which leads to a smaller volume or flow section in the branch pipe.

A vacuum unit in a vacuum sewage system normally runs intermittently in order to generate and maintain vacuum at or around a predetermined high vacuum level in the vacuum piping for ensuring the appropriate operation of the vacuum sewage system. When a source of sewage is used, e.g. a toilet is flushed, the vacuum level decreases as a result of air and sewage being drawn or flushed into the vacuum piping. After a certain amount of usage, the vacuum level decreases to a predetermined low vacuum level that represents a minimum required vacuum level for ensuring the operation of the vacuum sewage system. Consequently, at such a predetermined low vacuum level the vacuum unit is triggered to start or re-start in order to raise the vacuum level to said predetermined high vacuum level. In order to achieve this, the vacuum unit is run for an appropriate time period.

According to the method, additionally a start-up frequency of the vacuum unit is advantageously monitored by a counter unit, which registers the number of start-ups of the vacuum unit. The counter unit can be included in the control panel of the vacuum unit. The definition "start-up frequency" indicates the number of times the vacuum unit starts within a predetermined time period.

Preferably, a total number of start-ups within a predetermined time period is monitored. The number of start-ups can then be compared to a given second reference value for the total number of start-ups that can be acquired by carrying out the monitoring within a predetermined time period during e.g. a one month's time when the vacuum sewage system is taken into use and still intact and when the vacuum piping is still clean and un-contaminated, i.e. without blockage, partial blockage, deposits or layers formed in the vacuum piping.

Advantageously, when the duration of a running time is long in comparison to the given first reference value or the number of start-ups is high in comparison with the second given reference value, the vacuum level is monitored by a vacuum sensor placed at least at one predetermined position of the vacuum piping, which advantageously is at a sewage source end of a branch pipe.

In this manner, a problematic occurrence, such as leakage, can be determined and located.

In case the vacuum piping includes a number of branch pipes, a vacuum sensor is advantageously placed at the sewage source end of each branch pipe, whereby the vacuum levels indicated by the vacuum sensors placed at the sewage source end of each branch pipe are compared.

In order to monitor the branch pipes separately, the branch pipes can be closed by a shut-off valve for a predetermined time. The shut-off valve is advantageously motorized in order to allow for automatization.

The comparisons are advantageously timed so that the vacuum levels are compared at specific time intervals.

The vacuum unit deployed is a vacuum pump, e.g. a rotary lobe pump, a liquid ring pump, etc. or alternatively e.g. an ejector unit.

The monitoring and measuring of the running time and the start-up frequency as well as the monitoring and comparing of the vacuum levels are advantageously carried out by automation, which lies in the competence of a skilled person in the art as is therefore not described in any detail in this connection. The resulting data can then be indicated in an appropriate way in order to provide and to facilitate any required maintenance and repair measures.

The terms "long", "short", "low" and "high" are thus to be compared to said given reference values and indicate a clear deviation from the given reference values.

Firstly, in other words, if there is a given first reference value for the running time, i.e. a given measured running time, a "short", "shorter", "long", or "longer" running time indicates that there is a clear deviation in the running time from the reference value vis-à-vis the given first reference value. It is considered that a person skilled in the art is able to determine, if the deviation fulfils the criteria "short", "shorter", "long", or "longer".

Secondly, in other words, if there is a given second reference value for the start-up frequency, i.e. the number of start-ups, a "high", "higher", "low", or "lower" start-up frequency indicates that there is a clear deviation in the number of start-ups from the reference value vis-à-vis the given second reference value. It is considered that a person skilled in the art is able to determine, if the deviation fulfils the criteria "high", "higher", "low", or "lower".

Advantageous features of the method are given in claims 2-13.

BRIEF DESCRIPTION OF DRAWINGS

In the following the invention will be described, by way of example only, in more detail with reference to the attached schematic drawings, in which.

DETAILED DESCRIPTION

Figure 1:
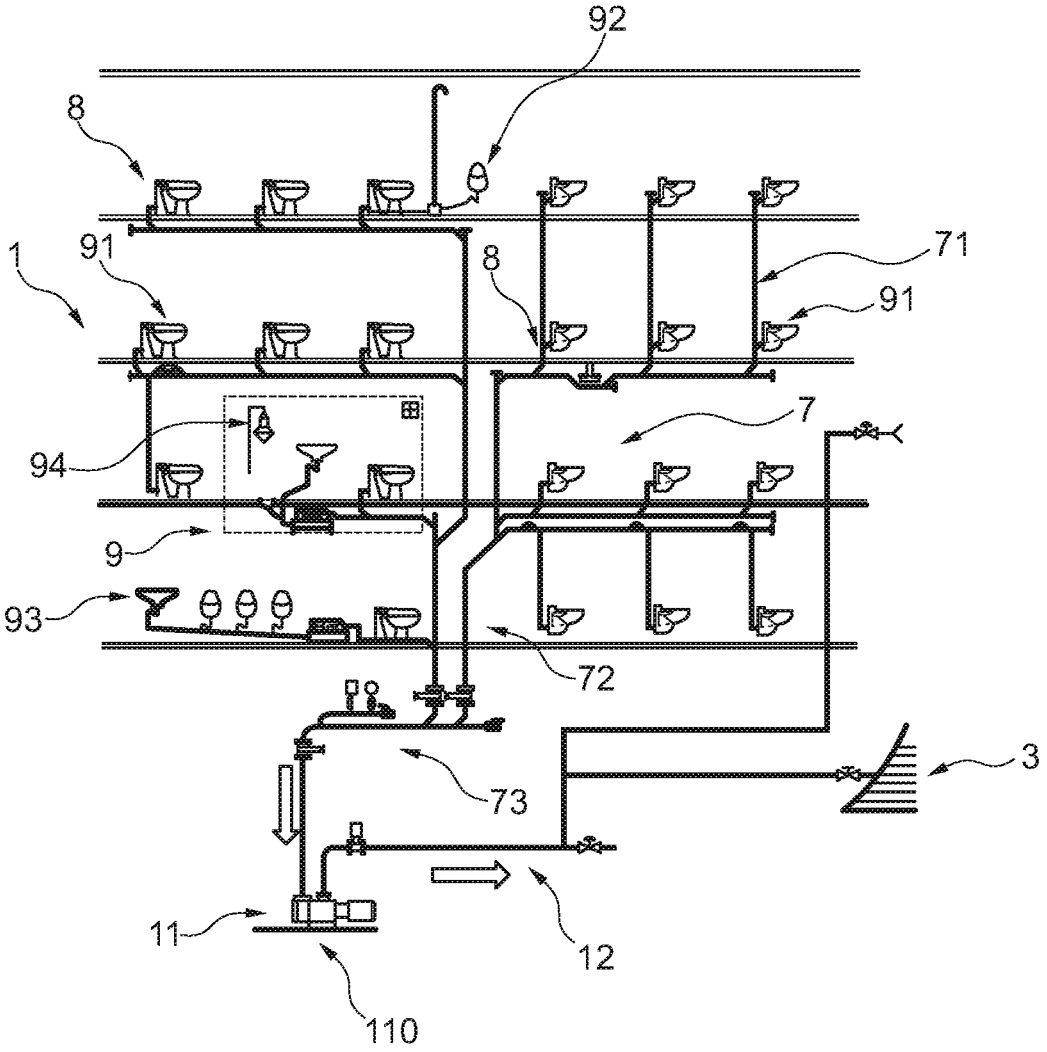
FIG. 1 illustrates a general layout of a vacuum sewage system for a building or for a marine vessel in which the method according to the present invention is used.

FIG. 1 illustrates a general lay-out of a vacuum sewage system 1 for a building or for a marine vessel. In other words, the vacuum sewage system according to the present invention is deployed, or located, as a whole, within a building or onboard a marine vessel. The term building is considered to include housing, hotels, department stores, supermarkets, industrial buildings, etc. The term marine vessel is considered to include yachts, ships, cruisers, freighters, off-shore platforms, etc.

In other words, the present invention relates to a vacuum sewage system, in which all components of the vacuum sewage system are arranged or located within a building or marine vessel. The transport of sewage by vacuum in the vacuum sewage system takes place within the building or the marine vessel. The present invention does not relate to a vacuum sewage system deployed outside a building and collecting and transporting sewage received from the building. In a corresponding manner, the present invention does not relate to a vacuum sewage system deployed outside a marine vessel, e.g. on a quay, for collecting and transporting sewage received from the marine vessel.

The vacuum sewage system comprises a source 9 of sewage, in this embodiment a number of sources of sewage, such as a toilet 91, a urinal 92, a wash basin 93, and a shower 94. The vacuum sewage system further comprises vacuum piping 7 including branch pipes 71, main pipe lines 72 and a collector 73. As indicated in FIG. 1, each source of sewage in the building or onboard the marine vessel, in this example the toilets 91, is individually, in other words separately, connected to the vacuum piping, or in this embodiment to the respective branch pipes 71, through discharge valves 8, which thus are arranged between each of the toilets 91 and the vacuum piping 7. A vacuum unit 11, which in this embodiment is illustrated as a vacuum pump 110, is connected to the collector 73 for generating vacuum and for pumping a flow of sewage in the vacuum piping of the vacuum sewage system. The vacuum unit 1 is further connected to a discharge pipe 12 for discharging the flow of sewage to a receiving facility 13 under atmospheric pressure. The vacuum unit can alternatively also be in the form of e.g. an ejector unit. For a vacuum sewage system onboard a marine vessel, the discharge facility could be e.g. a surrounding sea, a storage tank or a treatment plant. The flow of sewage is in the substantially in the form of sewage water.

Vacuum sewage systems of this kind are well known in the art and by a person skilled in the art and are therefore not discussed in greater deal in this connection.

The direction of the flow of sewage is indicated with block arrows.

Figure 2:
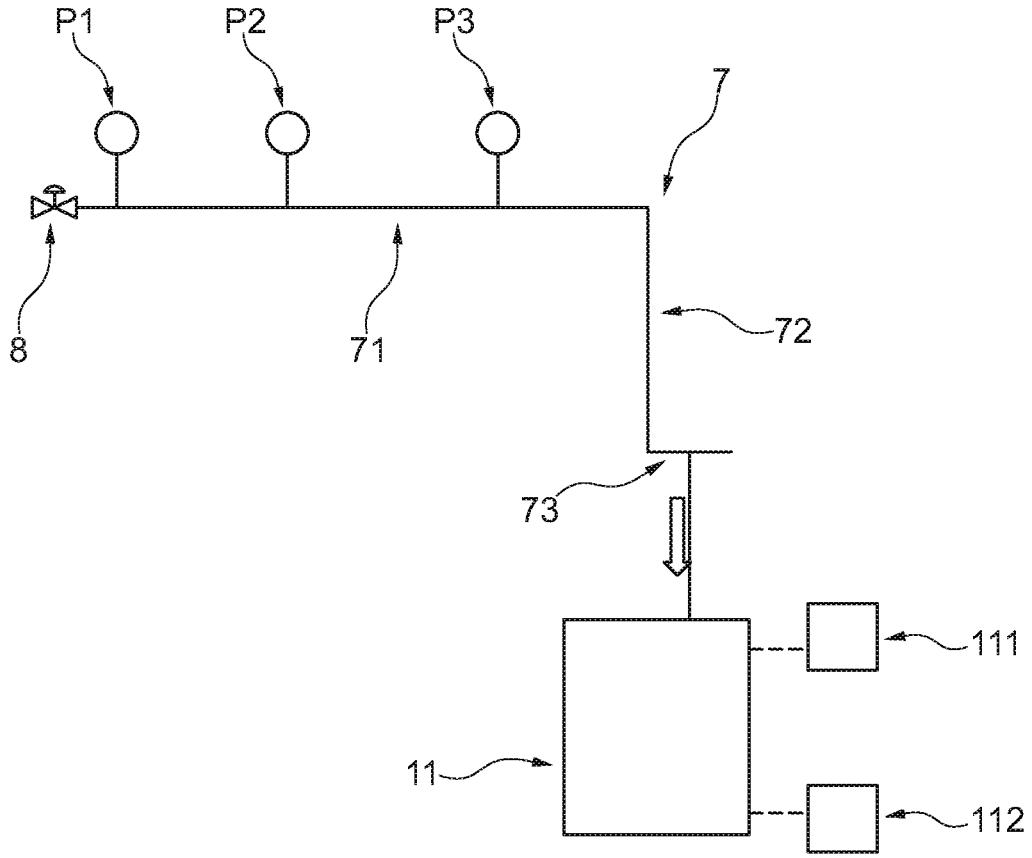
FIG. 2 illustrates an arrangement for localizing blockage, deposits or layers.
Figure 3:
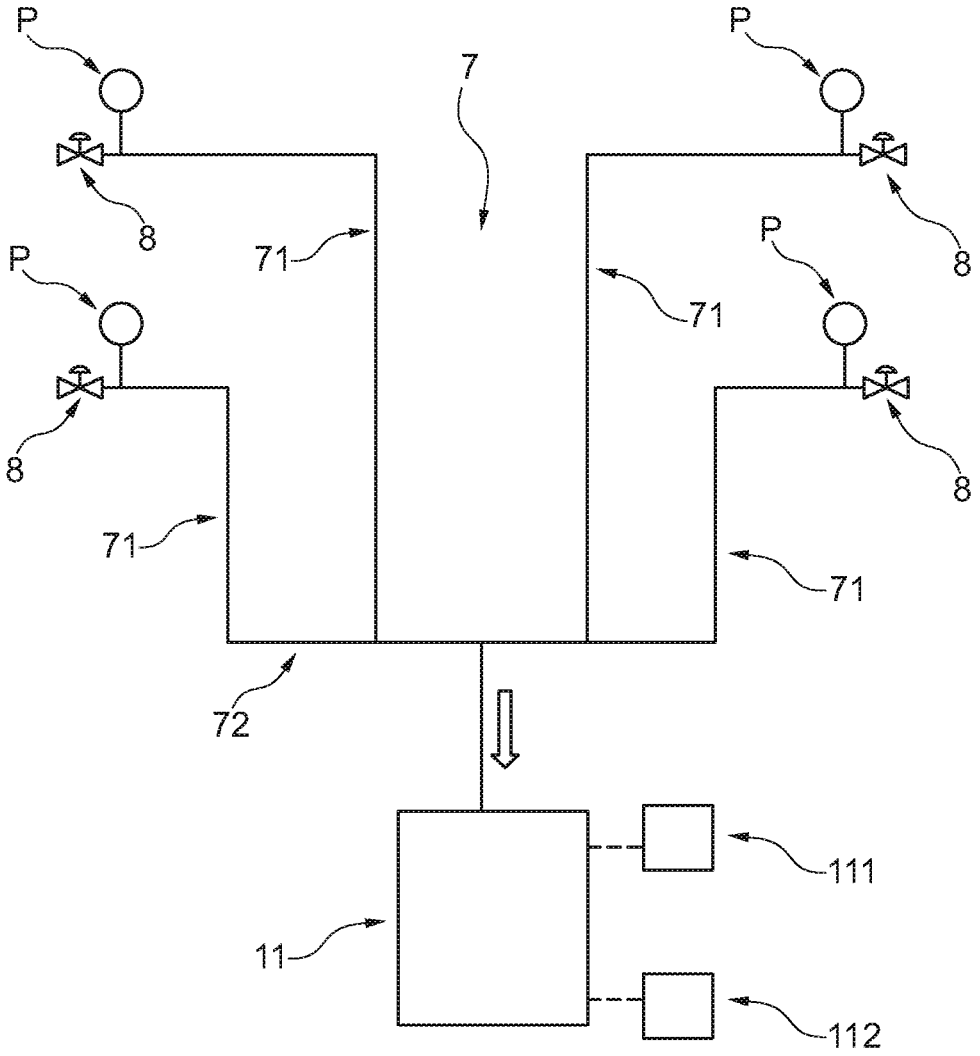
FIG. 3 illustrates an arrangement for localizing leakage.
Figure 4:
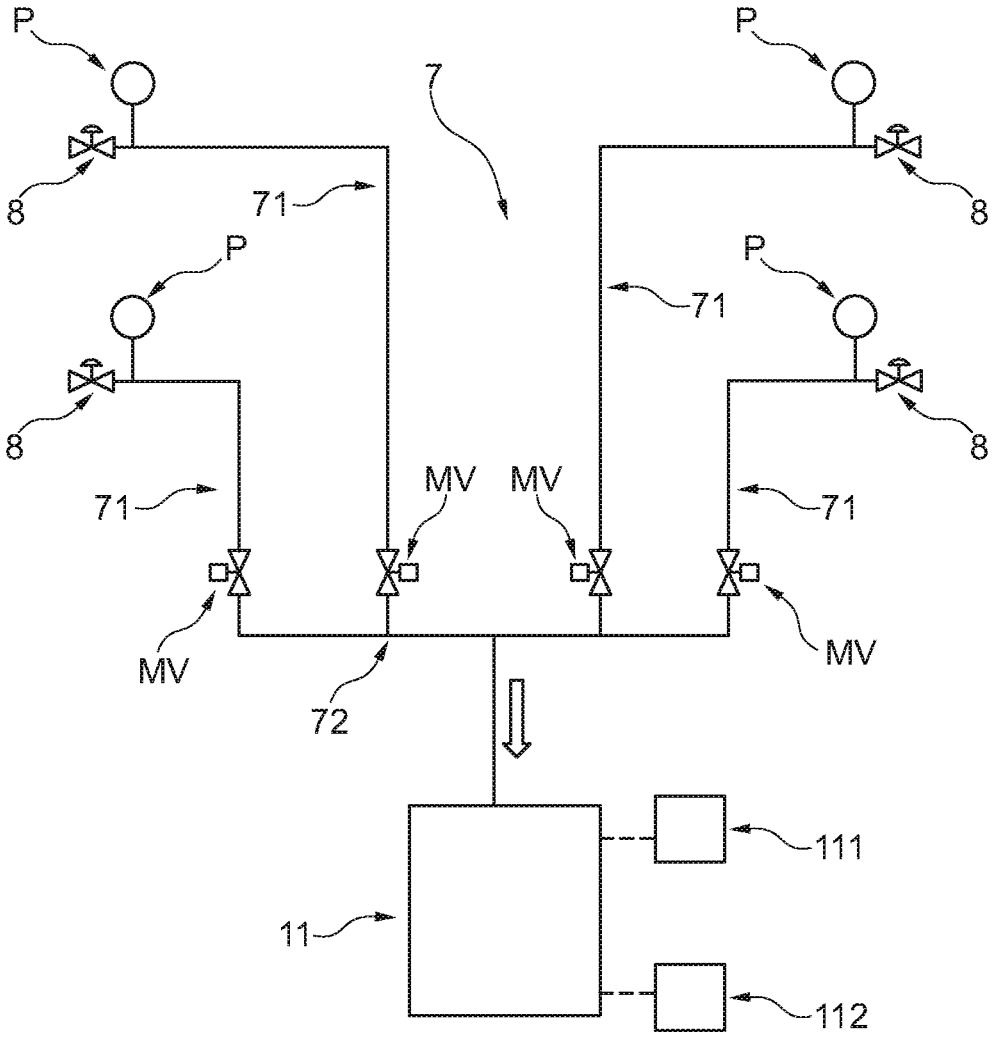
FIG. 4 illustrates an alternative arrangement for localizing leakage.

FIGS. 2, 3 and 4 illustrate various simplified examples of embodiments of the present invention which will be discussed in detail below. The embodiments include, as discussed above, a vacuum unit 11, vacuum piping 7 with a collector 73 (FIG. 2), a main pipe line 72, a branch pipe 71 and a discharge valve 8. The direction of the flow of sewage is indicated with a block arrow in these figures. The sources of sewage (not shown) are located upstream, in view of the direction of the flow of sewage, of the discharge valves.

The vacuum piping can be subject to leakage. Leakage can be controlled or detected by monitoring the running time of the intermittently operating vacuum unit 11. For this purpose the vacuum unit is provided with a running time meter unit 111 for registering the running time of the vacuum unit.

Alternatively, leakage can also be controlled or detected by monitoring the start-up frequency of the intermittently operating vacuum unit 11. For this purpose the vacuum unit 11 is provided by a counter unit 112 for registering the number of start-ups of the vacuum unit.

In order to achieve more reliable information the vacuum unit 11 can be provided with both a running time meter unit 111 and a counter unit 112, whereby two separate sources of data are made available for the monitoring purpose.

The running time meter unit 111 and the counter unit 112 are both shown in the embodiments of FIGS. 2, 3 and 4, but it is to be understood that they can be used separately or together as found appropriate. The running time meter 111 unit and/or the counter unit 112 are considered to be included also in the general layout of the vacuum sewage system as illustrated in FIG. 1 although they are not specifically referenced.

By monitoring the running time of the intermittently operating vacuum unit the following observations apply. Long running time periods indicate that there is a leakage in the vacuum piping. Short running time periods indicate that the volume of the vacuum piping has decreased, which indicates that a deposit or layer has formed in the vacuum piping. If the start-up frequency is high, this indicates a leakage in the vacuum piping.

The total running time of the vacuum unit 11 registered by the running time meter unit 111 within a predetermined time period is measured. In a corresponding manner, the total number of start-ups of the vacuum unit 11 registered by the counter unit 112 within a predetermined time period is registered.

Given reference values (first given reference value) for the running time can be acquired by carrying out the monitoring within predetermined time periods during e.g. a one month's time when the vacuum sewage system is taken into use, whereby it is still intact, without leakage, and whereby the vacuum piping is still clean or un-contaminated, i.e. without blockage, partial blockage, deposits or layers formed in the vacuum piping.

Given reference values (second given reference value) for the start-up frequency time can be acquired by carrying out the monitoring within predetermined time periods during e.g. a one month's time when the vacuum sewage system is taken into use, whereby it is still intact, without leakage, and whereby the vacuum piping is still clean or un-contaminated, i.e. without blockage, partial blockage, deposits or layers formed in the vacuum piping.

The terms "long", "short", "low" and "high" are thus to be compared to said given reference values and indicate a clear deviation from the given reference values.

Firstly, in other words, if there is a given first reference value for the running time, i.e. a given measured running time, a "short", "shorter", "long", or "longer" running time indicates that there is a clear deviation in the running time from the reference value vis-à-vis the given first reference value. It is considered that a person skilled in the art is able to determine, if the deviation fulfils the criteria "short", "shorter", "long", or "longer".

Secondly, in other words, if there is a given second reference value for the start-up frequency, i.e. the number of start-ups, a "high", "higher", "low", or "lower" start-up frequency indicates that there is a clear deviation in the number of start-ups from the reference value vis-à-vis the given second reference value. It is considered that a person skilled in the art is able to determine, if the deviation fulfils the criteria "high", "higher", "low", or "lower".

By establishing a problematic occurrence, e.g. a leakage or a decrease in the volume of the vacuum piping, as discussed above, the localization of the problematic occurrence is facilitated and can be carried out as described in more detail in connection with FIGS. 2-4 below.

If the vacuum sewage system is deployed onboard a marine vessel, the monitoring is advantageously done during night time when the usage of the sources of sewage, such as toilets, is low. In such a case, the monitoring is advantageously carried out during a predetermined time period during the night and on a daily basis, whereby the time period could advantageously be between e.g. 1 a.m. and 5 a.m. onboard time. If the vacuum system is deployed in a building, said time period would be chosen in a corresponding manner, when the usage of the sources of sewage is low.

FIG. 2 shows a first embodiment of the present invention, which provides for a manner for localization of a blockage, partial blockage, deposit or layer in the vacuum piping.

Firstly, the occurrence of a decrease in the volume of the vacuum piping, which indicates that a deposit or layer has formed in the vacuum piping, is considered to have been established based on the running time being short in comparison to the first given reference value as discussed above.

In this embodiment, after the decrease in the volume has been determined, the vacuum level is monitored at least at two separate predetermined positions of the vacuum piping, in this case at three separate positions of a branch pipe 71. A first vacuum sensor P1, a second vacuum sensor P2 and a third vacuum sensor P3 are placed downstream, in view of the direction of the flow of sewage, of the discharge valve 8 in the branch pipe 71. Each source of sewage 8 (not shown) is thus connected individually to a respective discharge valve 8 as discussed above in connection with FIG. 1.

In the operation of the vacuum sewage system, when a toilet, i.e. a source of sewage, is discharged or flushed and the sewage as well as a mass of air is pushed into the branch pipe 71 of the vacuum piping 7, the decrease of the vacuum level in the vicinity of the discharge valve 8 in connection with the discharge or flushing sequence is clear, if the branch pipe is open and clean, i.e. free of any contamination, i.e. blockage, partial blockage, deposit or layer in the branch pipe. Closer to the vacuum unit, i.e. farther away from the discharge valve, the decrease of the vacuum level is moderate.

However, if the branch pipe is contaminated or partially blocked, the decrease of the vacuum level is more radical than in an un-contaminated vacuum piping due to the diminished volume or flow section of the branch pipe due to formation of the partial blockage, deposits or layers in the branch pipe. Closer to the vacuum unit, i.e. farther away from the discharge valve, the decrease of the vacuum level is small, lesser than the moderate decrease with an open clean pipe.

Consequently, by monitoring and comparing the vacuum levels indicated by a set of adjacent vacuum sensors in series of vacuum sensors along the piping, the contaminated part of the piping can be appropriately localized. The number of vacuum sensors can be chosen as desired and is not limited to the example of three vacuum sensors as discussed above.

By using a number of vacuum sensors the contaminated point can be more exactly localized by comparing the vacuum levels indicated by a set of two adjacent vacuum sensors respectively.

FIG. 3 shows a second embodiment of the present invention, which provides for a manner for localization of leakage in the vacuum piping of the vacuum sewage system.

Firstly, the occurrence of leakage is considered to have been determined as described above, either by long running time as compared to a first given reference value or a high start-up frequency as compared to a second given reference value.

In this embodiment, after leakage has been determined, the vacuum level at a predetermined position of the vacuum piping 7 is monitored. A vacuum sensor P is placed at said predetermined position, advantageously at the sewage source end of the branch pipe 71, i.e. immediately downstream, in view of the direction of the flow of sewage, of the discharge valve 8. Each source of sewage 8 (not shown) is thus connected individually to a respective discharge valve 8 as discussed above in connection with FIG. 1.

FIG. 3 shows a vacuum sensor P placed in each of the four branch pipes 71 immediately downstream of the respective discharge valves 8. By comparing the vacuum level measured by the pressure sensor P in each branch pipe 71 the leakage can be localized to a specific branch pipe 71 of the vacuum piping 7.

FIG. 4 shows a third embodiment of the present invention, which provides for an alternative manner for localization of leakage in the vacuum piping of the vacuum sewage system.

Firstly, the occurrence of leakage is considered to have been established as described above in connection with FIG. 3.

In this embodiment, after leakage has been determined, the vacuum level at a predetermined position of the vacuum piping is monitored. A vacuum sensor P is placed at said predetermined position, advantageously at the sewage source end of the branch pipe 71, i.e. immediately downstream, in view of the direction of the flow of sewage, of the discharge valve 8. Each source of sewage 8 (not shown) is thus connected individually to a respective discharge valve 8 as discussed above in connection with FIG. 1.

FIG. 4 shows a vacuum sensor P placed in each of the four branch pipes 71 immediately downstream of the respective discharge valves 8.

At the downstream end of the branch pipe 71, just before the connection of the branch pipe 71 to the main line 72, each branch pipe 71 is additionally provided with a shut-off valve MV. The shut-off valve is advantageously motorized in order to allow for an automatized function. The branch pipe 71 is closed by the shut-off valve MV for a predetermined time, whereby the respective branch pipe 71 is isolated. The vacuum level is measured by the pressure sensor P. If the branch pipe 71 is intact, whereby in other words there is no leakage in the branch pipe, the vacuum level in the branch pipe does not decrease. In case there is a leakage, the vacuum level decreases evenly as a function of time. By monitoring the measured vacuum level the branch pipes can be checked for leakage. This is advantageously carried out in a timed manner so that the vacuum levels are compared at specific time intervals.

The respective monitoring, measuring and registering of the running time and the start-up frequency as well as the respective monitoring, measuring and comparing of the vacuum levels are advantageously carried out by automation, which lies in the competence of a skilled person in the art as is therefore not described in any detail in this connection. The resulting data can then be indicated in an appropriate way in order to provide and to facilitate any required maintenance and repair measures.

The drawings and the description related thereto are only intended for clarification of the basic idea of the invention. The invention may vary in detail, such as to the layout of the vacuum piping, the type of vacuum unit, the number of sources of sewage, the number of monitoring points, the type of running time meter, the type of counter unit, etc., within the scope of the ensuing claims.

The invention claimed is:

1. A method of controlling a vacuum sewage system within a building or within a marine vessel, which vacuum sewage system includes a vacuum unit, vacuum piping with at least a main pipe line and at least one branch pipe, at least one source of sewage, and a discharge valve between each of the at least one source of sewage and a respective branch pipe, wherein the vacuum unit generates a predetermined vacuum level in the vacuum piping, the method comprising:

monitoring a running time of the vacuum unit;

monitoring a vacuum level in the vacuum piping;

determining a first given reference value for the running time of the vacuum unit during a predetermined time period during which the running time of the vacuum unit is monitored; and monitoring the vacuum level in the vacuum piping at at least two separate predetermined positions the vacuum piping when a duration of the running time of the vacuum unit is less than the first given reference value.

2. The method of claim 1, further comprising comparing the monitored vacuum levels at the at least two separate predetermined positions with a discharge or flushing sequence of the source of sewage.

3. The method of claim 2, wherein comparing the monitored vacuum levels at the at least two separate predetermined positions with the discharge or flushing sequence of the source of sewage occurs at specific time intervals.

4. The method of claim 1, the running time of the vacuum unit is monitored by a running time meter unit, which registers the running time of the vacuum unit.

5. The method of claim 4, wherein a total registered running time within the predetermined time period is measured in order to determine the first given reference value for said running time.

6. The method of claim 1, wherein the vacuum level is monitored by at least two vacuum sensors placed in each of the at least one branch pipe of the vacuum piping, and in that the vacuum levels indicated by a set of two adjacent vacuum sensors placed in a branch pipe are compared in connection with a discharge or flushing sequence of the source of sewage.

7. The method of claim 1, further comprising monitoring a start-up frequency of the vacuum unit with a counter unit configured to register a number of start-ups of the vacuum unit.

8. The method of claim 7, further comprising registering the number of start-ups of the vacuum unit within a predetermined time to provide a second given reference value for the start-up frequency.

9. The method of claim 8, wherein, when the duration of the running time is greater than the first given reference value or the number of start-ups of the vacuum unit is greater than the second given reference value, the vacuum level is monitored by a vacuum sensor placed at least at one predetermined position of the vacuum piping.

10. The method of claim 9, wherein the vacuum sensor is placed at a sewage source end of a branch pipe.

11. The method of claim 9, wherein the vacuum piping includes a plurality of branch pipes and a vacuum sensor is placed at the sewage source end of each of the plurality of branch pipes, the method further comprising comparing the vacuum levels indicated by the vacuum sensors placed at the sewage source end of each of the plurality of branch pipes.

12. The method of claim 9, wherein the or each branch pipe is closed for a predetermined time by a shut-off valve placed in the branch pipe.

13. The method of claim 1, wherein the vacuum unit comprises one of a vacuum pump, a rotary lobe pump, a liquid ring pump, or an ejector unit.

* * * * *